US009981302B2

(12) United States Patent
Zhang et al.

(10) Patent No.: US 9,981,302 B2
(45) Date of Patent: May 29, 2018

(54) VERSATILE DYNAMIC STAMPING/RESTRIKING TOOL

(71) Applicant: Apple Inc., Cupertino, CA (US)

(72) Inventors: Yi Zhang, Campbell, CA (US); Stephen L. Williams, Florissant, MO (US); Ed Michael Pfeiffer, Portland, OR (US)

(73) Assignee: Apple Inc., Cupertino, CA (US)

( * ) Notice: Subject to any disclaimer, the term of this patent is extended or adjusted under 35 U.S.C. 154(b) by 662 days.

(21) Appl. No.: 14/604,656

(22) Filed: Jan. 23, 2015

(65) Prior Publication Data

US 2016/0089712 A1 Mar. 31, 2016

Related U.S. Application Data

(63) Continuation of application No. PCT/US2015/012688, filed on Jan. 23, 2015.

(Continued)

(51) Int. Cl.

*B21D 31/00* (2006.01)
*B21D 43/00* (2006.01)

(Continued)

(52) U.S. Cl.

CPC ..... *B21D 43/003* (2013.01); *B21D 5/01* (2013.01); *B21D 13/02* (2013.01); *B21D 22/02* (2013.01);

(Continued)

(58) Field of Classification Search

CPC ..... B21D 43/003; B21D 22/04; B21D 22/06; B21D 37/02; B21D 22/02; B21D 13/02; B21D 22/10; B21D 5/01; B21D 53/886

(Continued)

(56) References Cited

U.S. PATENT DOCUMENTS 4,212,188 A * 7/1980 Pinson ..... B21D 5/01 72/413
5,187,969 A * 2/1993 Morita ..... B21D 53/886 29/896.91

(Continued)

FOREIGN PATENT DOCUMENTS

JP 2010069534 4/2010
KR 101998063169 10/1998

(Continued)

OTHER PUBLICATIONS

PCT Application No. PCT/US2015/012688—International Search Report and Written Opinion dated Jun. 19, 2015.

*Primary Examiner* — David B Jones
(74) *Attorney, Agent, or Firm* — Dickinson Wright RLLP

(57) ABSTRACT

A stamping tool and a method for deforming a part with the stamping tool are disclosed. The stamping tool may include an array of striking members (e.g., pins), each striking member capable of being actuated independently with respect to the other striking members. In some embodiments, the stamping tool is part of a system having a vision system and a computing device. The vision system is capable of scanning the part to determine a location or location in which the array of striking members will engage the part. The deforming operation can include a rework operation subsequent to another process, or alternatively, the deforming operation can include deforming the part such that the part includes a three-dimensional shape. Also, the part can be a two-dimensional or three-dimensional part made from metal (e.g., aluminum, steel) or plastic.

20 Claims, 11 Drawing Sheets

Related U.S. Application Data

(60) Provisional application No. 62/057,723, filed on Sep. 30, 2014.

(51) Int. Cl.

| | |
|---|---|
| ***B21D 22/06*** | (2006.01) |
| ***B21D 22/10*** | (2006.01) |
| ***B21D 13/02*** | (2006.01) |
| ***B21D 22/02*** | (2006.01) |
| ***B21D 5/01*** | (2006.01) |
| ***B21D 53/88*** | (2006.01) |
| ***B21D 22/04*** | (2006.01) |
| ***B21D 37/02*** | (2006.01) |

(52) U.S. Cl.
CPC ..... *B21D 22/04* (2013.01); *B21D 22/06* (2013.01); *B21D 22/10* (2013.01); *B21D 37/02* (2013.01); *B21D 53/886* (2013.01)

(58) Field of Classification Search
USPC ..... 72/75, 413
See application file for complete search history.

(56) References Cited

U.S. PATENT DOCUMENTS

| | | | | |
|---|---|---|---|---|
| 5,546,784 | A * | 8/1996 | Haas | B21D 37/02 72/413 |
| 6,089,061 | A * | 7/2000 | Haas | B21D 37/02 72/14.8 |
| 6,151,938 | A * | 11/2000 | Park | B21D 22/10 72/413 |
| 6,578,399 | B1 * | 6/2003 | Haas | B21D 22/10 72/342.1 |
| 8,046,098 | B2 * | 10/2011 | Paik | B21D 13/02 700/145 |
| 8,322,176 | B2 * | 12/2012 | Johnson | B21D 22/02 72/115 |
| 2007/0193012 | A1 | 8/2007 | Bergman et al. | |

FOREIGN PATENT DOCUMENTS

| | | |
|---|---|---|
| KR | 100653740 | 12/2006 |
| KR | 20100066643 | 6/2010 |

* cited by examiner

VERSATILE DYNAMIC STAMPING/RESTRIKING TOOL

CROSS-REFERENCE TO RELATED APPLICATION

This application is a continuation of International Application PCT/US15/12688, with an international filing date of Jan. 23, 2015, entitled "Versatile Dynamic Stamping/Restriking Tool", and claims priority to U.S. Provisional Application No. 62/057,723 filed Sep. 30, 2014, each of which is incorporated herein by reference in its entirety.

FIELD

The described embodiments relate generally to stamping deformable materials. In particular, the present embodiments relate to versatile dynamic stamping tool for localized deformation.

BACKGROUND

Conventional stamping tools are used to perform a standard stamping operation to a part. These tools may be used to bend or crease the part in order to create a desired shape or configuration. Other conventional stamping tools may be used to provide relief from stress or strain incurred by a bending preceding stamping process.

However, these conventional stamping tools are limited to perform a static stamping operation. For example, the tool is generally stationary and configured to perform the same operation on subsequent parts. This may be less useful when stresses or other imperfections are in varying locations in which the static operation is not configured to provide relief.

SUMMARY

In one aspect, a dynamic stamping tool is described. The dynamic stamping tool may include a matrix of striking members comprising a striking member capable of independent actuation with respect to remaining striking members in the matrix and capable of striking a part in order to perform a deforming operation to the part. The dynamic stamping tool may further include a driving mechanism capable of actuating the striking member. The dynamic stamping tool may further include a vision system. The vision system may be configured to scan the part. The vision system may also be configured to determine a location at which selected striking members will engage the part to perform the deforming operation.

In another aspect, a stamping tool for deforming a part is described. The stamping tool may include several striking members. The several striking members may include a first striking member and a second striking member. The stamping tool may further include several driving mechanisms. The several driving mechanisms may include a first driving mechanism coupled to the first striking member and a second driving mechanism coupled to the second striking member. In some embodiments, the first driving mechanism is capable of actuating the first striking member. Also, in some embodiments, the second driving mechanism is capable of actuating the second striking member.

In another aspect, a method for performing a deforming operation to a part is described. The method may include scanning the part to create a profile of the part. The method may further include sending the profile to a computing device. The method may further include sending an instruction, based on the profile, from the computing device to a driving mechanism. In some embodiments, the driving mechanism is selected from a group consisting of a servo motor, a stepper motor, a can follower, and a piston. The method may further include actuating a striking member with the driving mechanism, based on the instruction, to engage the part. In some embodiments, the part is transformed from a first shape to a second shape different than the first shape.

In another aspect, a method for performing a deforming operation to a part is described. The method may include receiving a profile of a scanned part by a computing device. The method may further include sending an instruction, based on the profile, from the computing device to a driving mechanism. In some embodiments, the driving mechanism is selected from a group consisting of a servo motor, a stepper motor, a cam follower, and a piston. Also, in some embodiments, the driving mechanism actuates the striking member in response to the instruction to engage the part, causing the part to be transformed from a first shape to a second shape different than the first shape.

BRIEF DESCRIPTION OF THE DRAWINGS

The disclosure will be readily understood by the following detailed description in conjunction with the accompanying drawings, wherein like reference numerals designate like structural elements, and in which.

Figure 1:
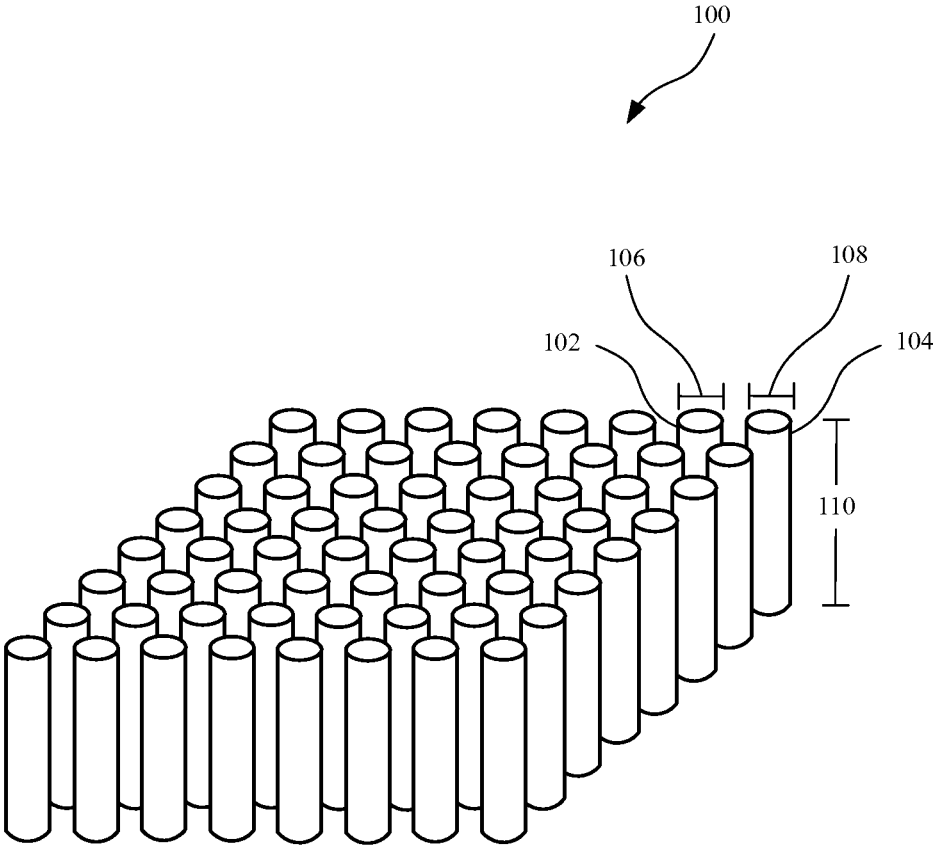
FIG. 1 illustrates an isometric view of an embodiment of an array of striking members.

Those skilled in the art will appreciate and understand that, according to common practice, various features of the drawings discussed below are not necessarily drawn to scale, and that dimensions of various features and elements of the drawings may be expanded or reduced to more clearly illustrate the embodiments of the present invention described herein.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting such that other embodiments may be used, and changes may be made without departing from the spirit and scope of the described embodiments.

The following disclosure relates to a dynamic stamping tool having a matrix, or array, of striking members (e.g., needles or needle-like structures), with each striking member capable of simultaneous actuation or independent actuation with respect to the remaining striking members in the matrix. The matrix of striking members can be actuated to engage or strike a part in order to perform a deforming operation to the part. In some cases, the deforming operation includes restoring the part to remove an irregularity or imperfection of the part, such that the part is within a specified tolerance. In other cases, the deforming operation is designed to form a two-dimensional or three-dimensional shape within the part. The needles can vary in size. In some cases, the surface area of a needle is approximately 0.1 square millimeters. Each needle may be connected to a small driving mechanism (e.g., motor) capable of actuating the striking member. A vision system can be used to scan the part to determine the location or locations in which the striking members will engage the part. The vision system may send an electrical signal as an input to a computing device (e.g., CPU). The computing device can then output an electrical signal to each of the driving mechanisms with the electrical signal carrying instructions for actuating the needles.

Also, the dynamic stamping tool can be oriented at several angles to perform the deforming operation. Further, the stamping tool is configured to conform to not only two-dimensional parts, but also three-dimensional parts.

These and other embodiments are discussed below with reference to FIGS. 1-18. However, those skilled in the art will readily appreciate that the detailed description given herein with respect to these Figures is for explanatory purposes only and should not be construed as limiting. Also, it will be appreciated that in the following embodiments, some structures may not be drawn to scale and are exaggerated or enlarged to show detail.

FIG. 1 illustrates an isometric view of an embodiment of array 100 of striking members, or simply referred to as array 100. As shown, array 100 includes first striking member 102 and second striking member 104, both of which may be representative striking member for the remaining striking members. In some embodiments, first striking member 102 and second striking member 104 are needle-like pins having a generally cylindrical body with first striking member 102 and second striking member 104 having first diameter 106 and second diameter 108, respectively, with first diameter 106 and second diameter 108 serving as representative diameters for the diameters of the remaining striking members. First diameter 106 and second diameter 108 may vary in different embodiments, and are approximately in the range of 0.2 millimeters to 1 millimeter. However, in other embodiments, first diameter 106 and second diameter 108 are greater than 1 millimeter. Also, the striking members (of array 100) may include length 110 approximately in the range of 0.5 to 3 centimeters. Also, the striking members may be made from rigid materials, such as steel. Other variations in material(s) will be discussed below.

Array 100 of striking members may form part of a tool used to deform a part, such as an enclosure of an electronic device. Deformation may include a rework operation to bend or relieve stress to the part to return the part to an initial shape prior to the bend or the stress. Deformation may also include forming a shape into the part, which may be a two-dimensional or three-dimensional shape. Also, the striking members of array 100 are capable of simultaneous actuation. However, in order to deform the part to a desired shape or dimension, each striking member of array 100 may move independently with respect to each other. Also, due to the nature of engaging or striking a part, array 100 is configured to allow for the individual striking members, such as first striking member 102 and/or second striking member 104, to be replaced if broken or worn down by a replacement striking member. This allows for continued use of array 100, that is, array 100 need not be discarded to due to one or more striking members breaking or wearing down, thereby lowering the overall cost of array 100.

Also, as shown in FIG. 1, array 100 is an 8×8 matrix of striking members. However, the number of striking members may vary according to the application. For example, in some embodiments, array 100 includes as few as two striking members. In other embodiments, ten or more striking members form array 100.

Figure 2:
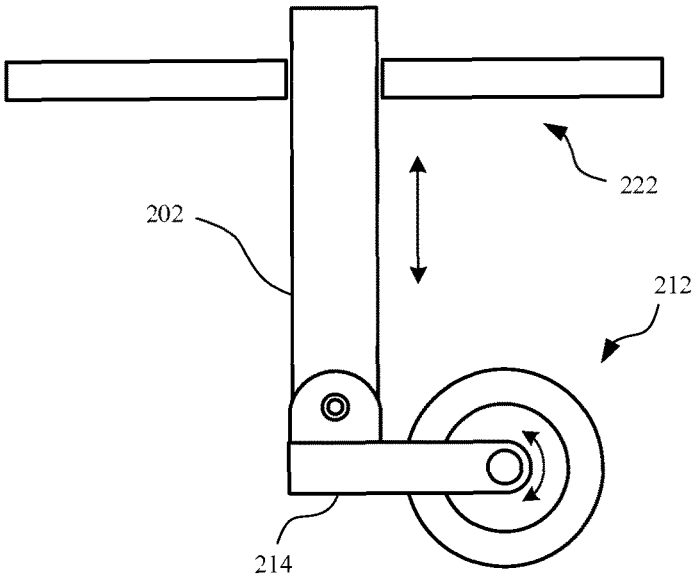
FIG. 2 illustrates a side view of an embodiment of a striking member actuated by a driving mechanism and a lever coupled to the striking member and the driving mechanism.
Figure 3:
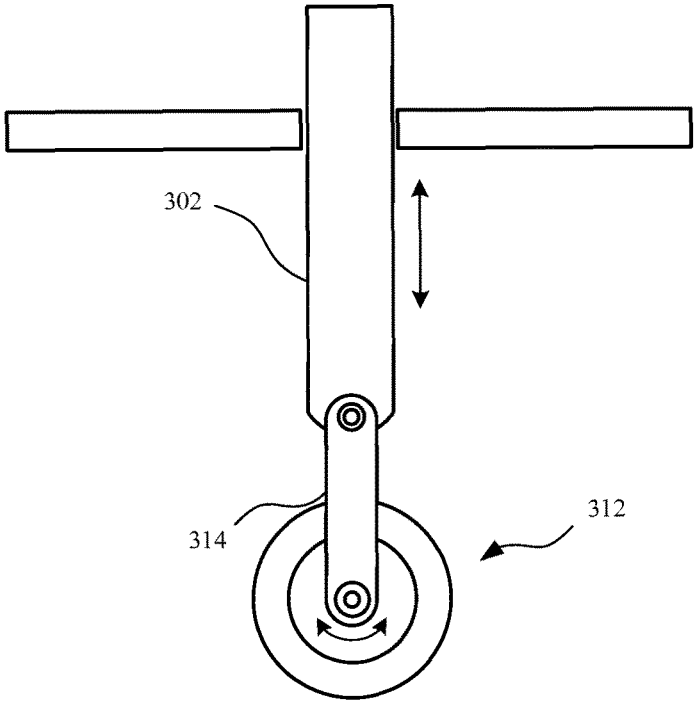
FIG. 3 illustrates a side view of an alternate embodiment of a striking member actuated by a driving mechanism and a lever, with the lever orientated in different manner.

FIGS. 2 and 3 illustrate exemplary techniques for actuating an individual striking member, in accordance with the described embodiments. FIG. 2 illustrates a side view of an embodiment of striking member 202 actuated by driving mechanism 212 and lever 214 coupled to driving mechanism 212 and striking member 202. It will be appreciated that striking member 202 is a representative striking member of several other striking members. As shown, striking member 202 may move in a linear direction (e.g., vertically up and down as denoted by linear arrows) in response to driving mechanism 212 rotating clockwise or counterclockwise (as denoted by non-linear arrows). In some embodiments, driving mechanism 212 is a motor, such as a stepper motor. In other embodiments, driving mechanism 212 is a cam follower engaged with a motor. Still, in other embodiments, driving mechanism 212 is a wobble plate (not shown) coupled to one or more striking members. In the embodiment shown in FIG. 2, driving mechanism 212 is a servo motor. Generally, any driving mechanism may be used which is relatively small in size and capable of actuating striking member 202 precise distances. For example, each striking member in an array (e.g., array 100) may move a distance ranging from approximately 40-50 micrometers to a few millimeters. Also, each striking member of an array may be coupled to a driving mechanism to allow for movement of individual striking members. Alternatively, a driving mechanism may be coupled to two or more striking members so long as the driving mechanism is capable of individually actuating each striking member. In some embodiments, guide 222 may be used to ensure striking member 202 extends in a substantially linear direction.

FIG. 3 illustrates a side view of an alternate embodiment of striking member 302 actuated by driving mechanism 312, with lever 314 oriented in a different manner. It will be appreciated that striking member 302 is a representative striking member of several other striking members. Driving mechanism 312 may be any driving mechanism previously described. Striking member 302 may also move linearly in response to rotational movement of driving mechanism 312 (as denoted by the arrows).

Figure 4:
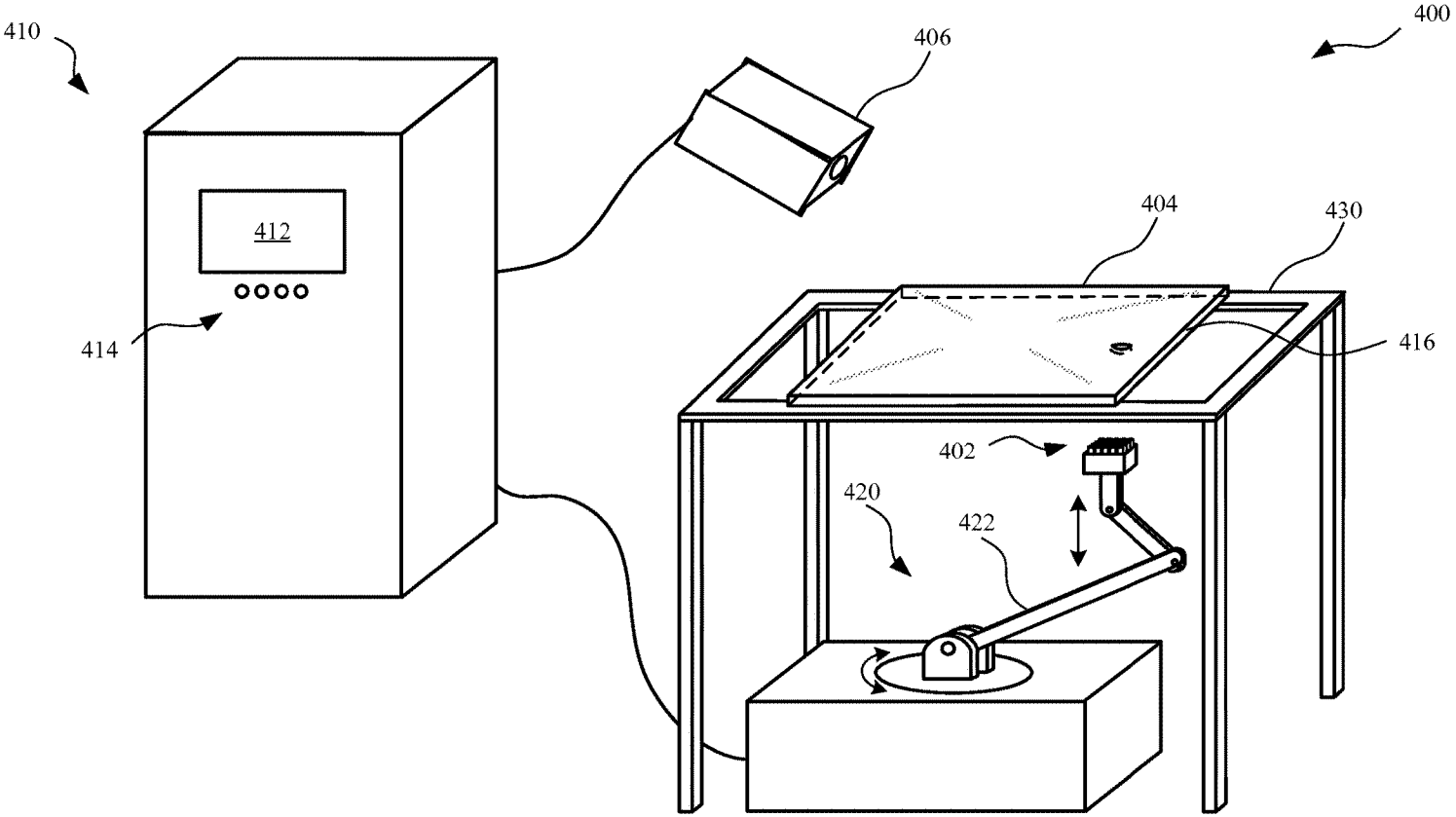
FIG. 4 illustrates an isometric view of a system that employs an array of striking members to perform a repair or rework operation to an enclosure, in accordance with the described embodiments.

FIG. 4 illustrates an isometric view of a system 400 that employs array 402 of striking members to perform a repair or rework operation to part 404, in accordance with the described embodiments. In some embodiments, part 404 is an enclosure of an electronic device. Also, part 404 may be made from metal (e.g., aluminum, stainless steel) or plastic. Also, in some embodiments, part 404 is a two-dimensional surface. In the embodiment shown in FIG. 4, part 404 includes a three-dimensional surface with defect 408 also having a three-dimensional configuration. However, the versatility of array 402 of striking members is such that the individual striking members can conform to a portion of part 404 and/or defect 408. As a result, array 402 of striking members can be used on various two-dimensional or three-dimensional surfaces.

System 400 may include vision system 406 configured to scan part 404 (e.g., enclosure of an electronic device or a display used with an electronic device) to identify defects or irregularities of part 404, such as defect 408. In some embodiments, vision system 406 includes several lasers, with each laser configured to measure a distance such that vision system 406 forms a three-dimensional profile of part 404. In the embodiment shown in FIG. 4, vision system 406 is a camera configured to capture an image. Also, in some embodiments, vision system 406 includes a processor (not shown) capable of processing an image and comparing it to an image of a part made within the specified tolerances, i.e., no defects. This comparison may be sent as an input via an electrical signal to computing device 410. Alternatively, vision system 406 may deliver raw data for processing to computing device 410.

In some embodiments, computing device 410 is a central processing unit ("CPU"). As shown, computing device 410 includes graphical user interface 412 and control inputs 414, both of which allow an operator to provide a control input to vision system 406, computing device 410, robotic assembly 420, and/or driving mechanism (not shown) of array 402 of striking members.

Computing device 410 is capable of receiving the electrical signal input from vision system 406—as either a raw image or a comparison—and processing the information. For example, computing device 410 may send instructions directly to the driving mechanisms (not shown) that actuate array 402 of striking members, or alternatively, as shown in FIG. 4, to a robotic assembly 420. These instructions, in the form of an electrical control output, provide a control signal to robotic assembly 420 not only to actuate robotic arm 422, but also to the driving mechanism to actuate array 402 of striking members in a desired manner. For example, array 402 of striking members is positioned proximate to defect 408 and instructions to the driving mechanism to actuate at least some of the striking members of array 402. In this manner, at least some of the array 402 engage part 404, and in particular, defect 408, to deform part 404 and remove defect 408 from part 404 such that part 404 is within a specified tolerance. Also, although not shown, part 404 may be positioned on table 430 in a different manner, and robotic assembly 420 may be configured to orient array 402 of striking members horizontally to remove a defect in a sidewall, such as first sidewall 416, of part 404. Also, in some embodiments, the input signal from vision system 406 to computing device 410 and/or control signal from computing device 410 to either robotic assembly 420 or driving mechanisms of array 402 may be sent and received via a wireless connection (e.g., Wi-Fi). In the embodiment shown in FIG. 4, system 400 uses wired connections.

Figure 5:
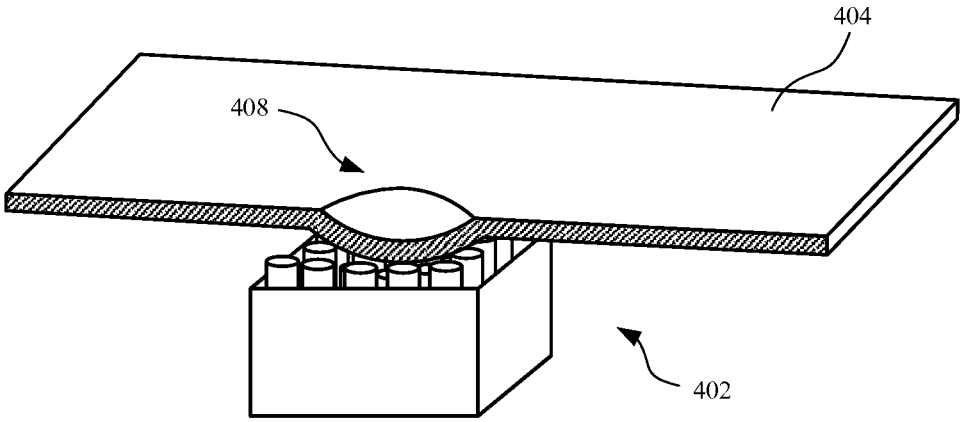
FIG. 5 illustrates a partial cross sectional view of an enlarged portion of a part having a defect, shown in FIG. 4.
Figure 6:
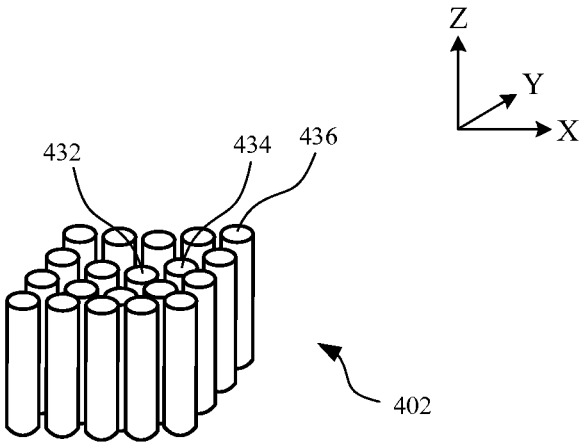
FIG. 6 illustrates the profile of the array of striking members shown in FIG. 5, with the part removed.
Figure 7:
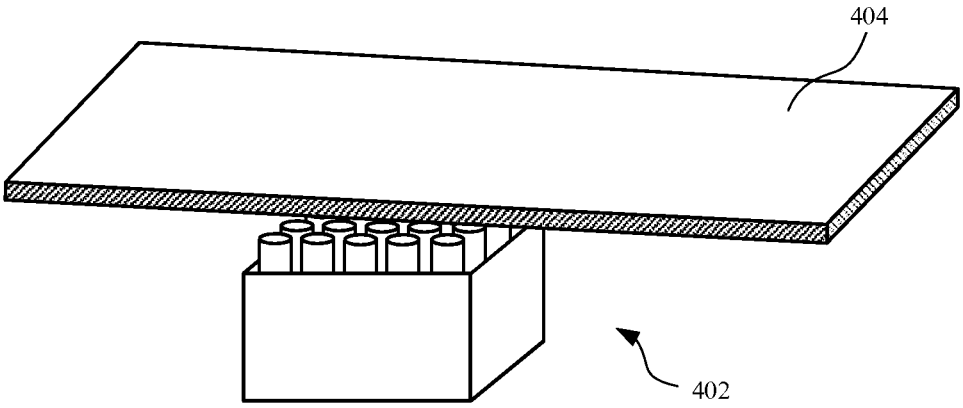
FIG. 7 illustrates the partial cross sectional view of the part shown in FIG. 5, with the defect removed due to actuation of the array of striking members.

FIGS. 5-7 illustrate an exemplary movement of array 402 of striking members. For purposes of clarity and illustration, some features are removed. FIG. 5 illustrates a partial cross sectional view of an enlarged portion of part 404 having defect 408, shown in FIG. 4. This illustration is intended to show array 402 of striking members are configured not only to move independently with respect to each other and conform to part 404, but also to show that some striking members move further than other striking members. Also, array 402 of striking members may include a lock (not shown) that prevents array 402 from lateral or other unwanted movement.

FIG. 6 illustrates the profile of array 402 of striking members shown in FIG. 5, with part 404 (in FIG. 5) removed. For example, in order to conform to the profile of defect 408 (in FIG. 5), both first striking member 432 and second striking member 434 are positioned lower, in the z-direction, than third striking member 436. Further, first striking member 432 is positioned lower than second striking member 434, in a z-direction. However, each striking member of array 402, including first striking member 432, second striking member 434, and third striking member 436, is configured for engagement with defect 408. It will be appreciated that array 402 of striking members can generally conform to the shape of any defect in order to remove the defect.

FIG. 7 illustrates the partial cross sectional view of part 404 shown in FIG. 5, with the defect removed due to the actuation of array 402 of striking members. As shown, array 402 of striking members is configured to restore part 404 to a contour or shape within a desired tolerance or specification. In other words, array 402 of striking members can be actuated (e.g., in a z-direction) based on instructions from, for example, computing device 410 (shown in FIG. 4), to remove a defect. Accordingly, in order to remove the defect, first striking member 432 (shown in FIG. 6) is actuated a greater distance than second striking member 434 (shown in FIG. 6), which in turn is actuated a greater distance than third striking member 436 (shown in FIG. 6). This illustrates the compound instructions the computing device can deliver to array 402 of striking members in order to perform a rework or repair operation. Accordingly, each striking member may perform an individual deformation such that the array 402 collectively forms a deformation.

Although the structures and processes described in FIGS. 4-7 are directed to fixing a defect, system 400 may also be configured to perform an operation to deform a two-dimensional or three-dimensional shape into part 404, such as an indicium (e.g., letter, logo, number, etc.) or multiple indicia. This will be discussed below.

Figure 8:
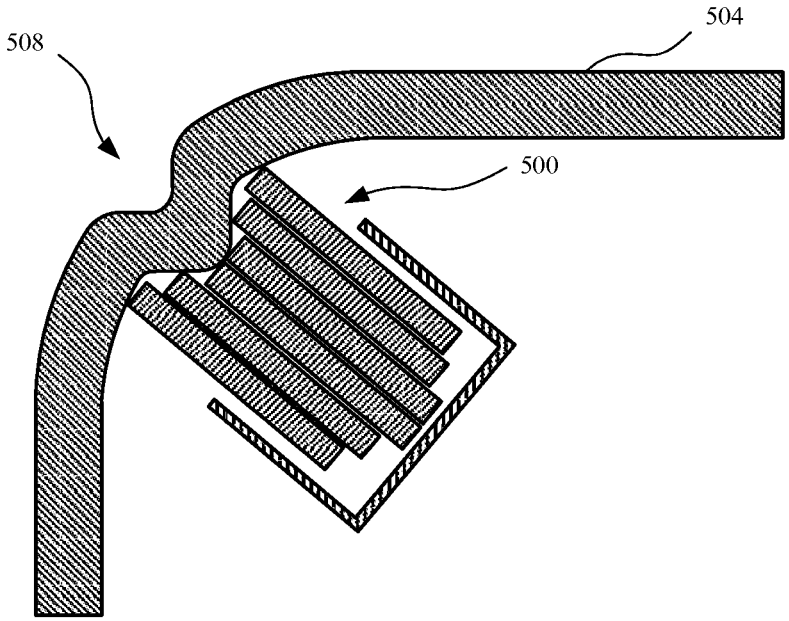
FIG. 8 illustrates a cross sectional view of an array of striking members orientated approximately at a 45-degree angle, in accordance with the described embodiments.
Figure 9:
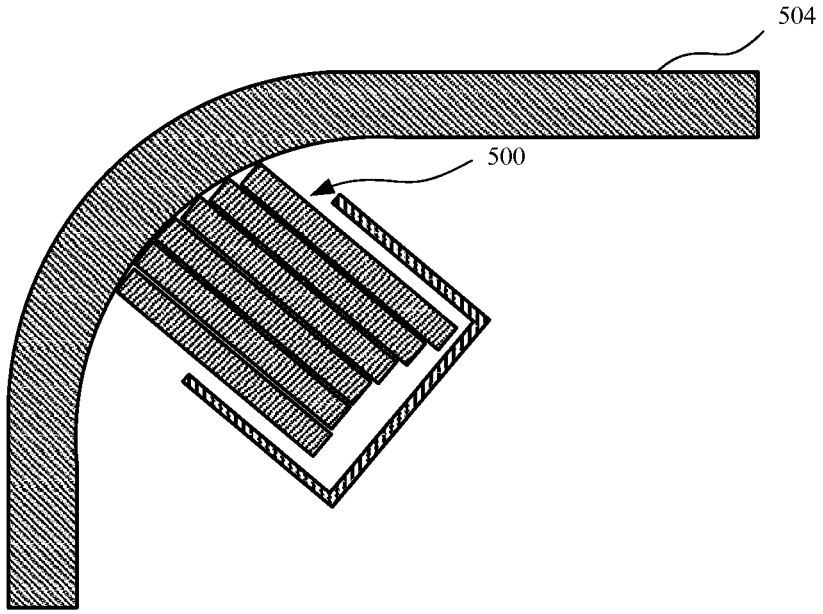
FIG. 9 illustrates a cross sectional view of the array of striking members engaged with the part, as shown in FIG. 8, with the defect removed due to actuation of the array of striking members.

The array of striking members can be oriented in different directions to perform a deforming operation at an angle. For example, FIGS. 8 and 9 illustrate an embodiment of array 500 of striking members oriented at an angle with respect to part 504 in order to perform a deformation operation to defect 508 of part 504. It will be appreciated that array 500 of striking members can be incorporated for use in a system, such as system 400 (shown in FIG. 4).

FIG. 8 illustrates a cross sectional view of array 500 of striking member oriented approximately at a 45-degree angle, in accordance with the described embodiments. However, the angle shown should not be construed as limited to a 45-degree angle as array 500 of striking members can generally be oriented in any angle with respect to part 504. As shown, array 500 of striking members is aligned with defect 508. FIG. 9 illustrates the cross sectional view of array 500 of striking member engaged with part 504, as shown in FIG. 8, with the defect of part 504 removed due to actuation of array 500 of striking members.

Figure 10:
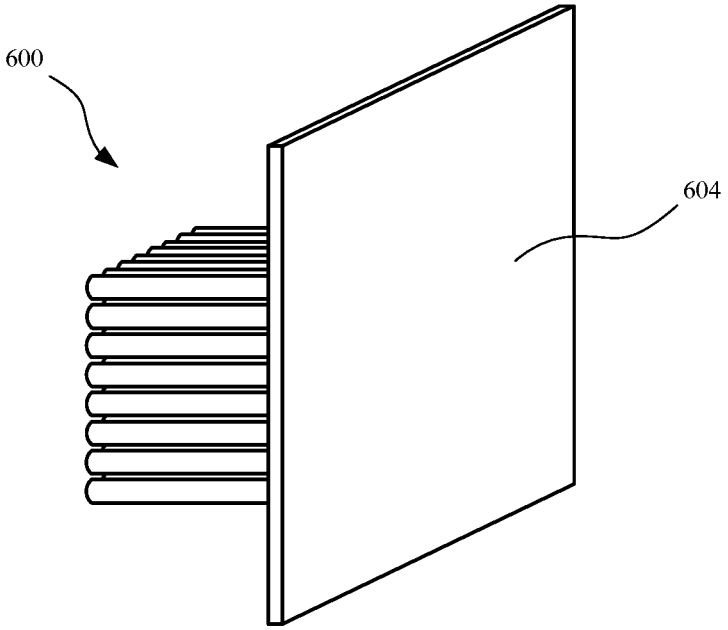
FIG. 10 illustrates an isometric view of an array of striking members engaged with a part.
Figure 11:
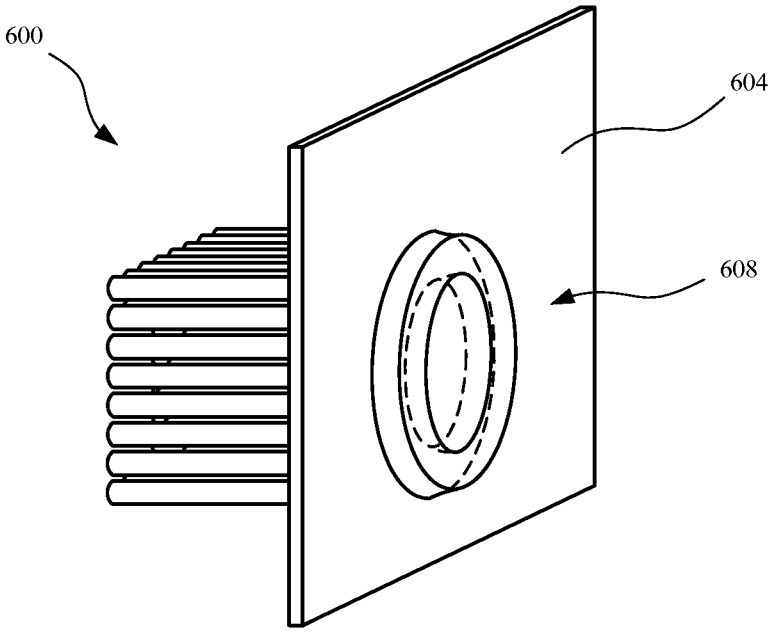
FIG. 11 illustrates the embodiment of the array of striking members and the part shown in FIG. 10, with the array of striking members actuated to deform the part to include a design.

FIGS. 10 and 11 illustrate an isometric view of array 600 of striking members configured to deform part 604 to incorporate a shape or design into part 604, in accordance with the described embodiments. FIG. 10 illustrates an isometric view of array 600 of striking members engaged with part 604. Part 604 may be made from any material previously described for a part. FIG. 11 illustrates the embodiment of array 600 of striking members and part 604 shown in FIG. 10, with array 600 of striking members actuated to deform part 604 to include a design 608. In particular, selected striking members of array 600 may be actuated to form design 608. Array 600 may receive a control input from a computing device (e.g., computing device 410 in FIG. 4) in order to actuate array 600 to form design 608 in part 604. As shown in FIG. 11, design 608 is generally ring-shaped. However, design 608 may be selected from a variety of indicia, including various polygonal configurations. This may include a letter, number, logo, etc.

Figure 12:
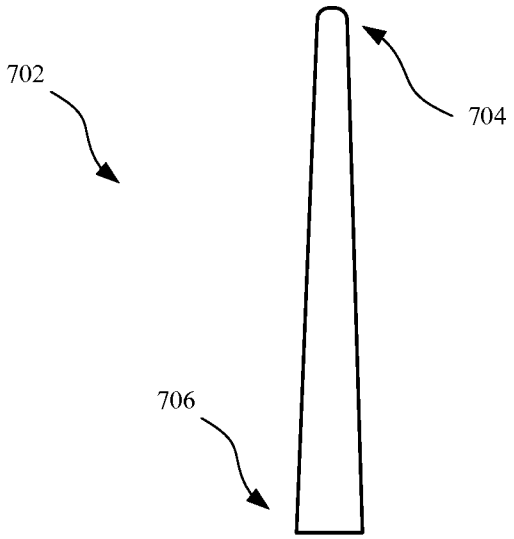
FIG. 12 illustrates a side view of an embodiment of a striking member having a needle-like configuration with a rounded tip region, further with the tip region have a smaller diameter than that of the base region.
Figure 13:
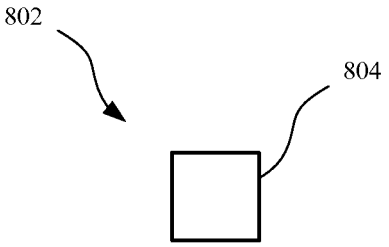
FIG. 13 illustrates a top view of a striking member having a four-sided configuration.
Figure 14:
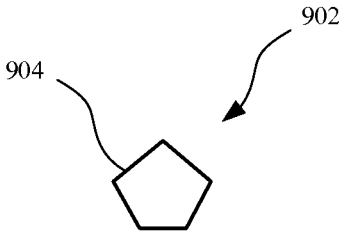
FIG. 14 illustrates a top view of a striking member having a five-sided configuration.

FIGS. 12-16 illustrate various embodiments of a striking member that may be incorporated as part of an array of striking members, in accordance with the described embodiments. Also, the embodiments shown in FIGS. 12-16 include dimensions substantially similar to those shown in previous embodiments, in terms of surface area and length. FIG. 12 illustrates a side view of an embodiment of striking member 702 having a generally rounded, needle-like configuration with tip region 704, with tip region 704 having a smaller diameter than that of base region 706. FIG. 13 illustrates a top view of striking member 802 having a four-sided configuration 804. FIG. 14 illustrates a top view of striking member 902 having a five-sided configuration 904.

Figure 15:
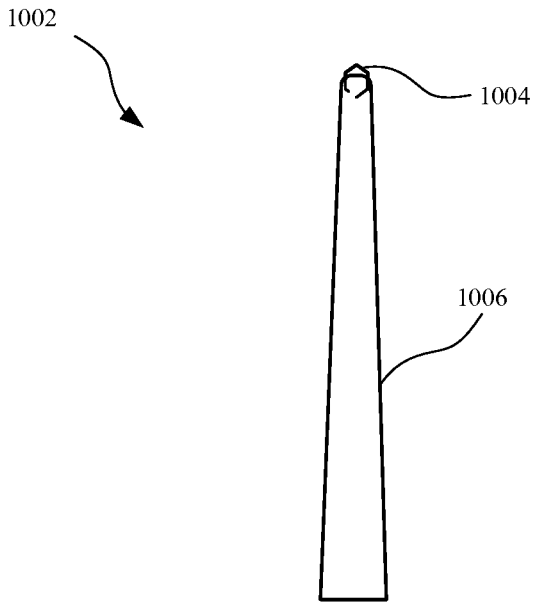
FIG. 15 illustrates a side view of an embodiment of a striking member formed from a first material and a second material embedded in the first material.
Figure 16:
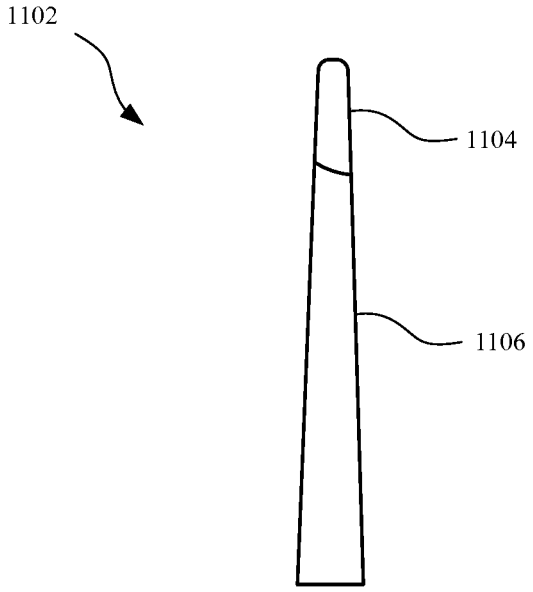
FIG. 16 illustrates a side view of an alternate embodiment of a striking member formed from a first material and a second material.

Some embodiments of a striking member may include multiple materials. For example, FIG. 15 illustrates a side view of an embodiment of striking member 1002 formed from first material 1004 and second material 1006. In some embodiments, second material 1006 is a diamond embedded in first material 1004. This may be used in instances when the part to be deformed is relatively stiff, or to perform a cutting or piercing operation to the part. FIG. 16 illustrates a side view of an embodiment of striking member 1102 formed from first material 1104 and second material 1106. First material 1104 may be made from a relatively dense and/or expensive material as compared to second material 1106. Striking member 1102 may be used for special applications in which first material 1104 is ideal for deforming a part. Also, in cases where first material 1104 is more expensive than that of second material 1106, striking member 1102 may be produced at a reduced cost by using less expensive materials. Also, in some embodiments, striking member 1102 is formed from a brazing process of first material 1104 and second material 1106. In some embodiments, a sintering process is used to form striking member 1102.

Although several embodiments of the array of striking members illustrate generally identical striking members, the striking members may vary in design, shape, and/or materials used within the array. Further, any of the striking members shown in FIGS. 12-16 may be used in at least some of the embodiments shown in this detailed description.

Figure 17:
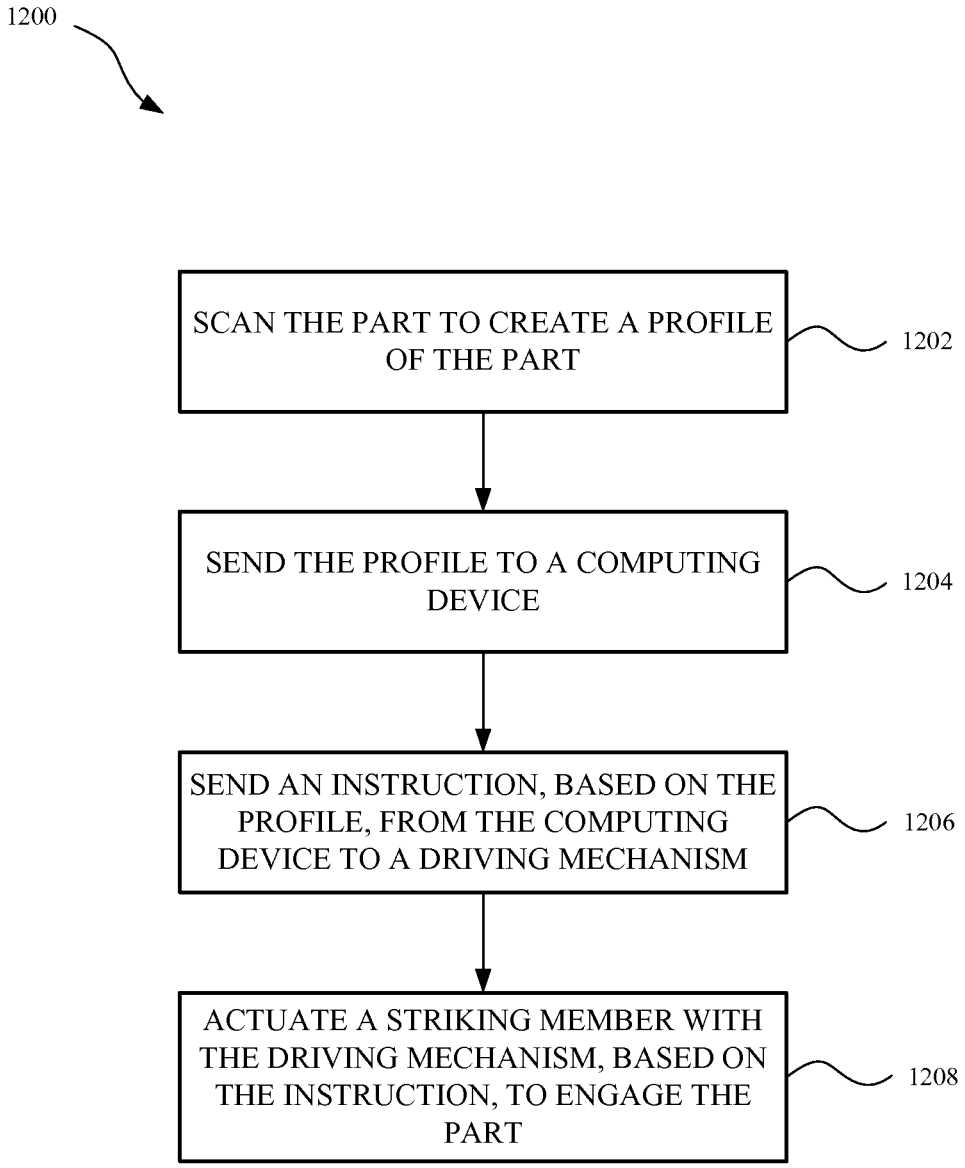
FIG. 17 illustrates a flowchart showing a method for performing a deforming operation to a part.

FIG. 17 illustrates a flowchart 1200 showing a method for performing a deforming operation to a part. In step 1202, the part is scanned to create a profile. Scanning means may be performed by a vision system. In some embodiments, the vision system creates a profile by comparing the scanned image of the part to an image of the part known to be within a specified tolerance. In other embodiments, the vision system is capable of transmitting the raw data to another device. Also, the vision system may include an array of lasers, with each laser configured to measure a distance from the vision system to the part to create a three-dimensional profile of the part.

In step 1204, the profile is sent to a computing device. This may be performed by a comparison or by sending raw data in a manner previously described. In some embodiments, the computing device is a central processing unit having at least one processor configured to process information transmitted from the vision system.

In step 1206, instructions are sent from the computing device to a driving mechanism. The instruction may be based on the information received by the computing device from the vision system. The instruction may include a control signal to actuate one or more of the driving mechanisms. In some embodiments, the instructions are sent to a robotic assembly to control the robotic assembly, which may include a robotic arm that carries an array of striking members. The instructions further include a control signal to one or more driving mechanisms to actuate corresponding striking members. Also, the driving mechanism or mechanisms may be selected from a servo motor, a stepper motor, cam follower, and a piston.

In step 1208, the driving mechanism actuates at least one striking member. The actuation is based on an instruction or instructions from the computing device. In this manner, the striking member engages the part to transform the part from a first shape to a second shape different from the first shape. In some embodiments, the second shape is part of a rework or repair operation to place the part within a specified tolerance. In other embodiments, the second shape is part of an indicium formed into the part, the indicium selected from a variety of desired shapes previously described.

Figure 18:
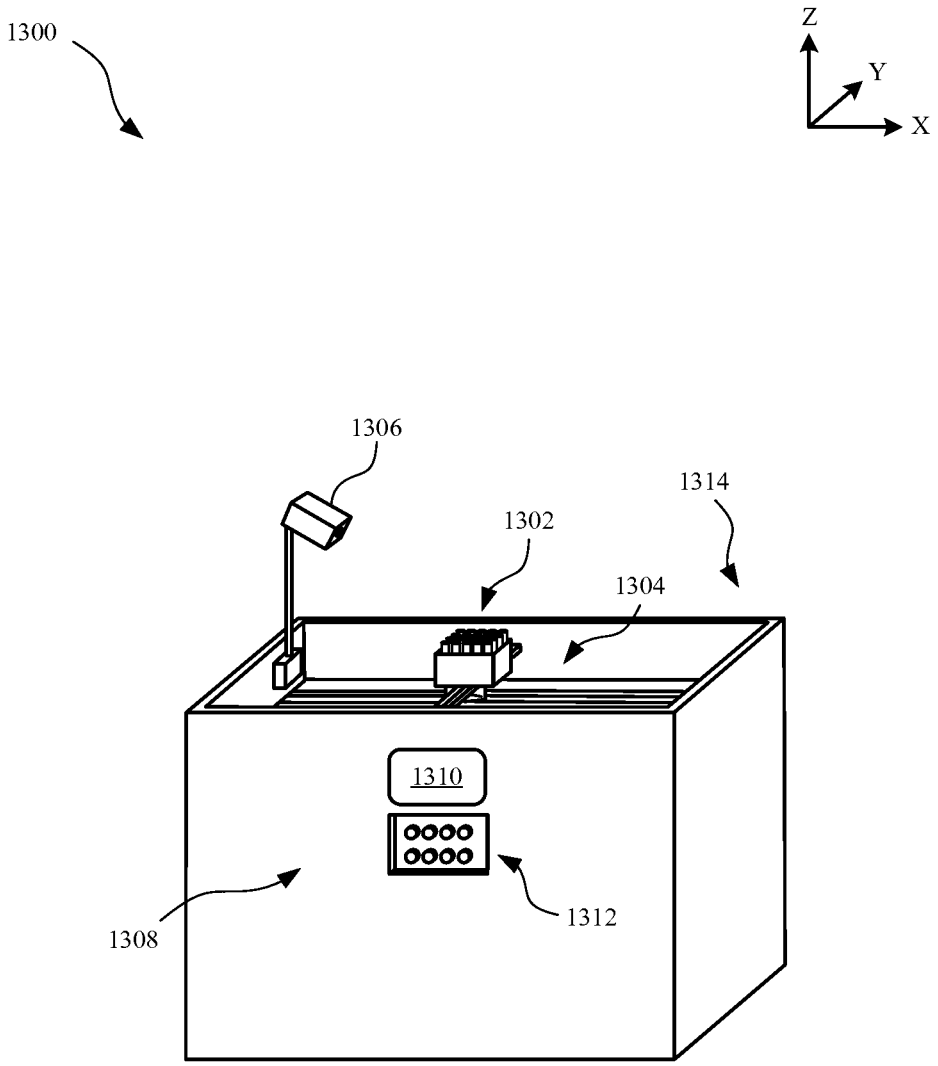
FIG. 18 illustrates an alternate embodiment of a system that employs an array of striking members to perform a repair or rework operation to an enclosure.

FIG. 18 illustrates an alternate embodiment of a system that employs an array of striking members to perform a repair or rework operation to enclosure. As shown, system 1300 includes components confined within system 1300, including array 1302 of striking members. Array 1302 is secured to a track 1304 configured to actuate array 1302 in x-, y-, and z-directions. System 1300 further includes vision system 1306 configured to view a part and provide feedback to a computing device (e.g., CPU) within system 1300. Vision system 1306 may include any device or configuration previously described for use within a system inspecting a part. System 1300 may further include control input region 1308 having monitor 1310 and control inputs 1312. In some embodiments, monitor 1310 may be a graphical user interface that allows for control inputs to the computing device. Several control inputs are available, such as starting and stopping operations (of system 1300), changing parameters of array 1302 and/or vision system 1306, and inputting to the computing device which part is positioned within system 1300. It will be appreciated that array 1302 of striking members are configured to deform a part (e.g., enclosure of an electronic device) in order to remove a defect, based on an electrical control signal received from the computing device. The electrical control signal may be derived from an input received from vision system 1306.

In some embodiments (not shown), an upper region 1314 of system 1300 is configured to receive several walls, one of which includes a door. In this manner, system 1300 is equipped with safety features to prevent or limit injury. Also, system 1300 could be used to deform a part to include a two- or three-dimensional shape in a manner previously described.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. A system for modifying a shape of an exterior surface of an enclosure for a portable electronic device, the system comprising:

a controller capable of providing a striking instruction;

a driving mechanism in communication with (i) the controller, and (ii) at least one striking member; and a vision system in communication with the controller, the vision system configured to (i) determine a strike location on the exterior surface, and (ii) send information corresponding to the strike location to the controller, wherein the controller uses the information to provide the striking instruction to the driving mechanism that, in turn, causes the at least one striking member to strike the exterior surface at the strike location.

2. The system as recited in claim 1, wherein modifying the shape of the exterior surface causes the enclosure to be within a specified predetermined tolerance.

3. The system as recited in claim 1, wherein, prior to modifying the shape, the exterior surface has a three-dimensional surface.

4. The system as recited in claim 1, wherein the at least one striking member includes a surface area of approximately 0.1 square millimeters.

5. The system as recited in claim 1, wherein the at least one striking member is part of an array of striking members that are capable of conforming to the shape of the exterior surface while the controller causes the at least one striking member to strike the exterior surface at the strike location.

6. The system as recited in claim 1, further comprising:

a robotic assembly in communication with the driving mechanism and the controller, the robotic assembly being capable of further causing the at least one striking member to strike the exterior surface at the strike location.

7. The system as recited in claim 6, wherein the controller is capable of causing the at least one striking member to strike the exterior surface at the strike location in a direction that is generally orthogonal to the exterior surface.

8. The system as recited in claim 5, wherein the at least one striking member is capable of being independently actuated by the driving mechanism relative to remaining striking members of the array of striking members.

9. A stamping system for deforming a portion of an enclosure for a portable electronic device, the stamping system comprising:

an array of striking members comprising at least a first striking member and a second striking member that are capable of being actuated to deform the portion of the enclosure;

a robotic assembly in communication with the array of striking members, the robotic assembly being capable of positioning the array of striking members in a direction towards the portion of the enclosure; and at least one driving mechanism in communication with the robotic assembly and the array of striking members, wherein the at least one driving mechanism is capable of actuating the array of striking members to strike the portion of the enclosure, thereby deforming the portion of the enclosure.

10. The stamping system of claim 9, wherein the robotic assembly is capable of positioning the array of striking members in a non-perpendicular direction relative to the portion of the enclosure.

11. The stamping system of claim 9, wherein the at least one driving mechanism includes a first driving mechanism capable of actuating the first striking member, and a second driving mechanism capable of actuating the second striking member.

12. The stamping system of claim 9, wherein the at least one driving mechanism is capable of actuating the array of striking members in x-, y-, and z-directions.

13. The stamping system of claim 9, further comprising:

a controller in communication with the at least one driving mechanism and the robotic assembly, the controller being capable of providing striking instructions for actuating the array of striking members based on the portion of the enclosure.

14. The stamping system of claim 11, wherein the first driving mechanism is a first motor and the second driving mechanism is a second motor.

15. The stamping system of claim 13, further comprising:

a vision system in communication with the controller, the vision system being capable of determining the portion of the enclosure.

16. A method for modifying an enclosure for a portable electronic device, the method comprising:

receiving a profile of a three-dimensional surface of the enclosure;

generating modification parameters that are based on the profile; and sending an instruction that includes at least the modification parameters to a driving mechanism, wherein the driving mechanism is in communication with an array of striking members, and the instruction causes the driving mechanism to actuate the array of striking members to impact the three-dimensional surface of the enclosure with a strike force, thereby modifying the three-dimensional surface according to the modification parameters.

17. The method of claim 16, wherein the driving mechanism is in communication with a robotic arm, and the robotic arm carries the array of striking members in a direction towards the three-dimensional surface.

18. The method of claim 16, wherein actuating the array of striking members comprises performing a rework operation to the enclosure.

19. The method of claim 16, wherein the array of striking members includes at least a first striking member and a second striking member, and the first striking member is independently actuatable from the second striking member.

20. The method of claim 19, wherein the first striking member is capable of being actuated at a first distance, and the second striking member is capable of being actuated at a second distance that is different from the first distance.

* * * * *